United States Patent [19]

Fairbairn

[11] 4,168,569

[45] Sep. 25, 1979

[54] ELECTRICAL CONTACT EXTRACTION APPARATUS

[75] Inventor: Leroy W. Fairbairn, Sidney, N.Y.

[73] Assignee: The Bendix Corporation, Southfield, Mich.

[21] Appl. No.: 883,626

[22] Filed: Mar. 6, 1978

[51] Int. Cl.[2] ..... H01R 43/00

[52] U.S. Cl. ..... 29/764; 29/758

[58] Field of Search ..... 29/739, 764, 758, 278, 29/280, 629; 81/3 R

[56] References Cited

U.S. PATENT DOCUMENTS

| | | | |
|---|---|---|---|
| 3,587,159 | 6/1971 | Dunkow | 29/764 |
| 3,802,049 | 4/1974 | Hennessey, Jr. | 29/764 |

*Primary Examiner*—Carl E. Hall

*Attorney, Agent, or Firm*—Kenneth A. Seaman; Raymond J. Eifler

[57] ABSTRACT

An apparatus for extracting an electrical contact (400) from a housing passage (510), said apparatus including a first member (100) with an internal bore (130) extending rearwardly from a forward end (110) and a second member (200) having a tapered or pointed forward end (211) and movably mounted within the bore of said first member. The electrical contact (400) preferably has a plurality of aligned wires (410) and held within a passage of an electrical connector insert. When the first member (100) is inserted over the contact (400) and the second member (200) is moved forward, the pointed end (211) of the second member urges the wires radially outward and into pressure contact with a portion of the bore (130) of the first member. The axially aligned wires are in pressure contact for removal of the contact simultaneously with the removal of the apparatus. The first member has an axial slot extending rearwardly from the forward surface to accommodate a bent wire.

7 Claims, 8 Drawing Figures

FIG. 1
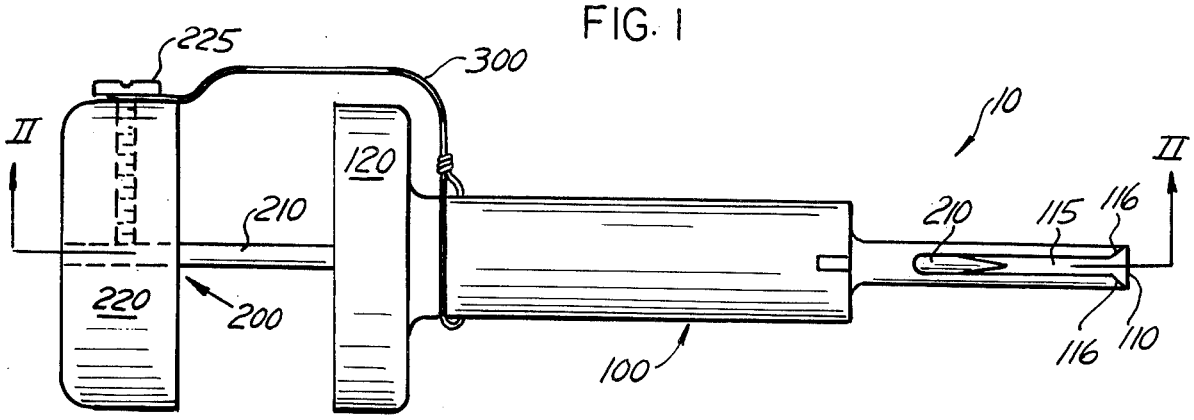
FIG. 2
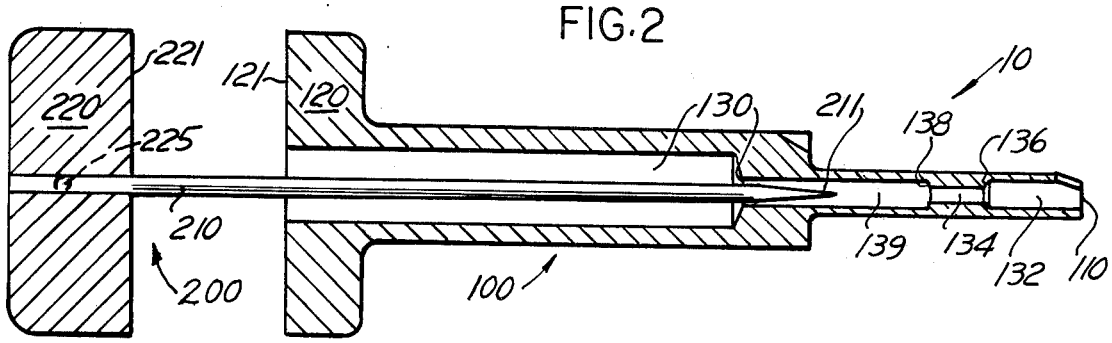
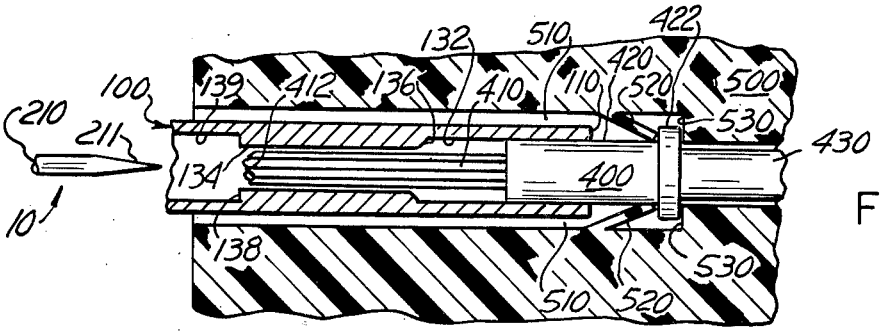
FIG. 3
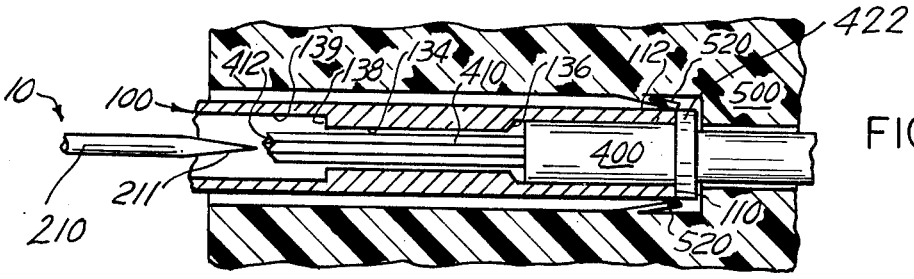
FIG. 4

FIG. 5
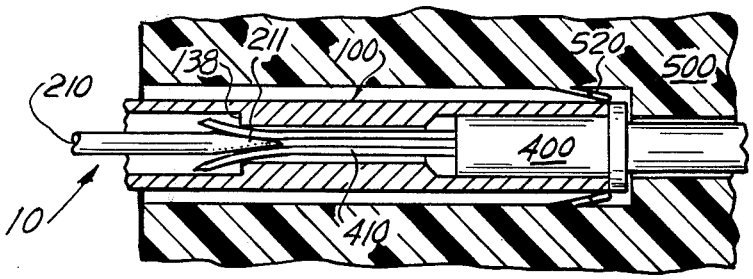
FIG. 6
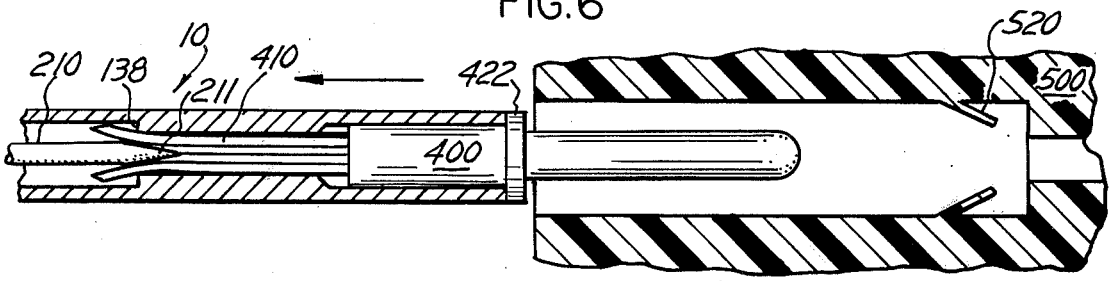
FIG. 7
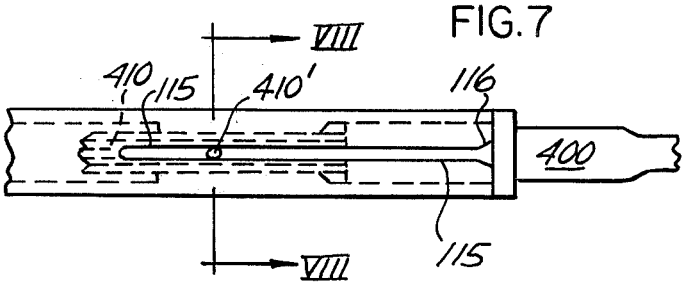
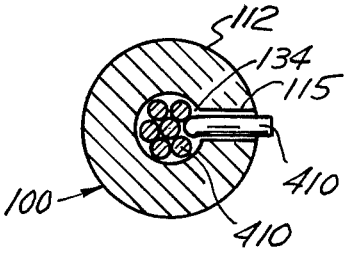
FIG. 8

ELECTRICAL CONTACT EXTRACTION APPARATUS

TECHNICAL FIELD

The present invention relates generally to an apparatus or a tool for removing an electrical contact from a mounting within an electrical connector for replacement of the contact.

Typically, an electrical connector includes an insert or housing having a plurality of parallel passages extending therethrough. Associated with each passage is a plurality of spring-like fingers which form a retention cone. The fingers or retention cone releasably maintain the contact within a passage by engaging an enlarged shoulder of the contact.

Accordingly, the object of a contact extraction apparatus is to release the contact from the retention cone and remove the contact from the passage.

BACKGROUND ART

Prior art tools for removing electrical contacts from an insert or housing passage are known. These tools have generally a sleeve or modified sleeve configuration. The sleeve may be modified to have an axial slit through the sleeve end thereof or to include a plunger. Typically, the sleeve is inserted over the contact to release it from the housing passage. Then a portion of the contact (such as an outwardly extending wire) is manually grasped and pulled to remove the contact from the passage. Alternatively to such grasping, some prior art extraction tools use a plunger through the passage.

A requirement to manually grasp the contact requires the use of both of the operator's hands in some cases and other cases require access simultaneously to both sides of the contact. Since it is frequently impossible or undesirable to access both sides of the contact simultaneously or to require the use of both hands, such prior art systems have limitations.

Further, the apparatus which require manual grasping of an exposed portion of the contact to accomplish the removal of a contact presupposes that there will be such an exposed portion. Modern electrical connectors, however, do not always have such an exposed portion for removal. Accordingly, such prior art apparatus are not appropriate for these situations.

Prior art extraction tools which are sleeves are disadvantageous in that the tool will not operate when a portion of the contact is bent away from its customary position. Since contacts including a plurality of fine (e.g. diameter of 0.008 inches) wires are in use and occasionally one of the wires is bent away from alignment to have a perpendicular portion, such tools maybe ineffective to remove the contact with a bent wire.

Accordingly, the electrical contact extraction apparatus of the prior art have significant undesirable features or limitations.

DISCLOSURE OF THE INVENTION

The present invention is a novel apparatus for removing an electrical contact from a passage within an electrical connector insert which overcomes the undesirable features or limitations of the prior art removal tools. This apparatus is particularily adapted for removing a contact which includes a plurality of fine, axially aligned wires.

This apparatus allows for the removal of an electrical contact where the contact is not simultaneously accessible from both passage ends. The apparatus of the present invention also allows for the removal of a damaged or defective contact where one face of the insert is not accessible by permitting contact removal from a single face.

The apparatus of the present invention has the additional advantage that a contact may be removed from a connector passage using only one hand.

The apparatus of the present invention has the additional advantage of being adapted to remove a contact including one or more bent wires. An optional, rearwardly extending axial slot extending through a external portion of the apparatus and into communication with a central bore accommodates such bent wires.

Further, the apparatus of the present invention allows for the removal of a electrical contact where there is no external or exposed portion of the contact which might be manually grasped to assist in the removal of the contact.

The apparatus of the present invention includes a first member (100) having a central bore extending rearwardly from a forward surface (110) and is adapted to be inserted within a housing passage (510) over a contact (400). A second member (200), including a tapered forward end portion (211), is mounted within a bore (130) of the first member (100) for movement between a rear position and a forward position. The first member has an exterior surface (112) adapted to be inserted into the passage of an electrical connector insert and release the contact from a truncated contact retention cone located within the passage. When the first member is inserted over the contact and the second member is moved into its forward position, the pointed forward end (211) forces axially aligned wires (410) radially outward and into pressure contact with an interior wall portion of the bore (130) of the first member, preferably a rearwardly facing shoulder (138) between a smaller forward bore portion (134) and a larger rear bore portion (139). When the axially aligned wires (410) are in pressure contact with the wall portion (138), removal of the apparatus (10) simultaneously removes the electrical contact (400) from the insert passage (510). Preferably, the insert (500) includes a truncated retention cone (520) located coaxially with the passage (510) for receiving a shoulder (422) of the sleeve (420) to hold the contact (400) within the insert passage (510), and a forward external portion (110) of the first member releases the retention cone (520) from the shoulder (420) upon insertion of the first member over the contact.

Advantageously, the first member includes an axial slot (115) extending rearwardly from the forward surface (110) of the first member and communicating with the bore (130), whereby if one or more of the axially aligned wires (410) has been bent to have a portion extending radially outwardly from the wire bundle, the slot (115) may be inserted over the wire (410) and the contact removed from the passage (510) despite the bent wire.

Other objects and advantages of the present invention will be apparent to one skilled in the art in view of the following description and claims and the accompanying drawings.

BRIEF DESCRIPTION OF THE DRAWINGS

FIG. 1 is a perspective view of the electrical contact extraction apparatus or tool of the present invention.

FIG. 2 is a cross-sectional view of the apparatus shown in FIG. 1, looking in the direction of line 2—2 in FIG. 1.

FIG. 3 is a cross-secional view of a portion of an electrical connector insert including a passage with an electrical contact mounted therein and forward portion of the extraction apparatus is partially inserted over the contact.

FIG. 4 is a view of the same contact and insert passage as in FIG. 3, with extraction apparatus completely inserted over the electrical contact.

FIG. 5 is a view of the passage and electrical contact of FIGS. 3 and 4, after a rear member of the extraction apparatus is moved forwardly to engage fine wires of the contact.

FIG. 6 is a view of the electrical connector insert portion and contact of FIGS. 3-5 with the contact partially removed from the passage by the contact removal apparatus.

FIG. 7 is a view of an electrical contact having a bent wire and showing a slot in the extraction apparatus which accommodates the bent wire.

FIG. 8 is a cross-sectional view of the contact having a bent wire and removal tool as shown in FIG. 7, looking in the direction of the line 8—8.

BEST MODE FOR CARRYING OUT THE INVENTION

FIG. 1 illustrates the electrical contact removal apparatus of the present invention. The apparatus or tool 10 includes a first member 100 and a second member including a portion which is mounted within the the first member 100. The first member 100 and the second member 200 are secured together by a steel wire 300, which allows a limited movement of the second member 200 relative to said first member 100.

The first member 100 is preferably made of a tool steel material and includes a forward end portion 110. A slot 115 is cut through the periphery of the first member into a center bore from the forward end rearwardly. The slot 115 includes a forward outwardly-tapering portions 116.

The second member 200 includes a needle 210 which is mounted to a head portion 220 by set screw 225. The needle 210 is preferrably of the type used for sewing, and a style 2020, size 14 needle made by the Singer Company has been used successfully. The head portion 220 is preferably made of tool steel, other materials such as plastic or aluminum might be used.

The steel wire 300 secures said first member 100 to said second member 200. One end of the wire 300 is held to the second member 200 by the head of the set screw 225 in the head portion 225. The other end of the wire 300 is fastened around an enlarged rear portion 120 of the first with enough wire slack to allow limited movement between said first and second members, preferrably without allowing disassembly of the members.

FIG. 2 shows a cross-sectional view of the apparatus or tool 10 of FIG. 1. As illustrated, the first member 100 has a internal bore 130 having a larger diameter portion 132 extending rearwardly from the forward end 110 of the first member 100. A smaller diameter portion 134 is located rearwardly of the larger diameter portion 132. A tapering wall portion 136 is located between the larger diameter portion 132 and the smaller diameter portion 134. A second larger diameter portion 139 is located rearwardly of the small diameter portion, with a rearwardly facing shoulder 138 located between the portions 134, 139.

A second member 200 is mounted to the first member 100 said second member 200 having a pointed end 211 of the needle 210 extending into the bore 130, preferably rearwardly of the larger diameter portion 132.

As shown in FIG. 2, the second member 200 is in its rear or retracted position. The second member 200 is mounted to be movable forward with respect to the first member 100 toward the forward end 110 until a forward edge 221 of the base portion 220 is in contact with a rear edge 121 of the enlarged rear portion 120 of the first member. When the second member 200 is moved forward, the pointed end 211 preferably is within the smaller diameter portion 134 of the bore 130 and forward of the position shown in FIG. 2, with the tapering surface of the pointed end is in contact with the rearwardly facing shoulder 138.

FIGS. 3-6 illustrate the use of the apparatus 10 to remove an electrical contact 400 from a housing 500.

FIG. 3 shows a forward portion of the apparatus 10 with the forward end 110 of the member 100 being inserted over the contact 400 which is mounted to the housing or insert 500, with only a portion of the contact and housing shown.

The contact 400 includes outwardly extending, axially aligned wires 410, each of which wires preferably includes an acutely angled end surface 412 as more fully described in U.S. Pat. No. 3,725,844 to McKeown et al. for "Hermaphoditic Electrical Contact". The wires 410 are mounted to and held within a sleeve or holder 420 which has an enlarged shoulder 422. The contact 400 includes an end 430 which is made in a suitable shape for an electrical termination, which might be a tail for a solder connection to a printed circuit board or a solderless wrap tail, such as is sold under the trademark Wire-Wrap, depending on the application or end use for the contact 400.

The electrical connector housing or insert 500 is shown with a passage 510 in which the contact 400 is mounted. Extending radially inwardly within the passage 510 are springlike fingers 520 which are resiliently radially deflectable to selectively allow the shoulder 422 of the contact 400 to pass therethrough. A plurality of fingers (preferably three or more) are spaced radially about the passage to form what is sometimes referred to as a contact retention cone. Also associated with the passage 510 is a stop 530 which is positioned to prevent the contact from moving further toward the right in FIG. 3. The stop 530 might be an annular shoulder or a segmented shoulder.

Accordingly, as shown in FIG. 3, the contact 400 is captivated (or held relatively immovable) within the passage 510 of the insert 500 by the location of the shoulder 422 positioned between the contact retention cone or fingers 520 and the stop 530. The insert, including the cone and stop, may consist of one or more pieces; one such arrangement is described in U.S. Pat. No. 3,165,369 to Maston .

As shown in FIG. 3, the forward end 110 of the apparatus 10 has been inserted completely over the wires 410 of the contact 400 and partially over the sleeve 420.

The ends 412 of the wires 410 were guided by the tapering wall portion 136 of the bore into the smaller diameter portion 134 of the bore. The pointed end 211 of the needle 210 is located away from the ends 412 of the wires 410.

FIG. 4 shows the contact removal apparatus 10 with the first member 100 completely inserted over the portion of the contact 400 extending from the shoulder 422 toward the tool 10. The forward end 110 of the first member 100 is in contact with the shoulder 422 of the contact 400. An outer surface 112 of the first member has moved the fingers 520 radially outward to release the contact shoulder 422 from the fingers 520.

While the ends 412 of the wires 410 have moved further rearwardly within the bore and beyond the rearwardly facing shoulder 138, the pointed end 211 of the needle 210 is still spaced from the ends 412 of the wires.

The wires 410 substantially, but not completely, fill the smaller diameter portion 134 of the bore of the first member.

FIG. 5 shows the contact removal apparatus 10 and the contact 400 of FIG. 4, with the second member, including the pointed end 211 of the needle 210 moved forward (into its forward position) with respect to the first member 100 and the contact 400.

In the forward position of the second member, the free end portions of the wires 410 are moved radially outwardly by the pointed end 211 of the needle 210 into pressure contact with the rearwardly facing shoulder 138. By the pressure contact between the wires 410 and the rear facing shoulder 138, the contact 400 is firmly coupled to the contact extraction apparatus 10 and capable of being removed from the housing 500 simultaneously with the removal of the apparatus 10.

FIG. 6 shows the removal of the contact 400 from the housing 500 when the apparatus 10 is removed. The wires 410 are held in pressure contact with the rearwardly facing shoulder 138 by the pointed end 211 of the needle 210, which is held in its forward position during contact removal. After the shoulder 422 of the contact 400 passes through the resiliently deformable fingers 520 during contact removal, the fingers 520 return to their undeformed state.

After the contact has been removed, the movement of the needle 210 back to its rear position (not shown) with respect to the first member 100 allows the release of the contact 400 from the apparatus 10.

FIG. 7 shows the use of the slit 115 in the first member to accommodate an outwardly bent wire 410' in the axially aligned wires 410 of a contact 400. During insertion (not shown) of the first member 100 over the contact 400, the slot 115 and outwardly-tapering portions 116 are aligned radially with the bent wire 410' and the first member 100 is then moved axially to surround the contact with the bent wire 410' extending through the slot 115. The outwardly-tapering portions 116 allow a less-precise alignment of the slit 115 with the bent wire 410' by providing an inclined edge which urges the bent wire 410' into the slot 115.

FIG. 8 shows another view of the use of the present apparatus for removing an contact with the bent wire 410' by the use of the slot 115. The slot 115 extends through a wall of the apparatus to communicate with the central bore, shown in its smaller diameter portion 134. While the wires 410 are axially aligned, the wire 410' includes a portion which has been bent transverse to the axially aligned wires 410. Without the slot 115 to accommodate the wire 410', this wire would be further bent or mangled or possibly broken off altogether, making removal of the contact more difficult.

The present apparatus is especially advantageous in that the operator need only access one side of the contact during removal and, further, the apparatus may be easily used with only one hand. The removed contact is also held within the apparatus after removal, so it may be easily inspected or disposed of.

It is preferred embodiment, the slot 115 is wide enough to accommodate more than one bent wire therein simultaneously. The slot 115 has a length which is long enough to include preferably several wires along the length.

Other objects and advantages of the present invention will be apparent to those skilled in the art in view of the foregoing description. For example, other configurations of the first member might be used advantageously. Depending on the size of the contact, the bore portions may not be of different diameters and a rearwardly facing shoulder might not be required.

Further, a different method of mounting the second member within the first member (i.e., within a bore which extends only partially through the first member) might be used without departing from the spirit of the present invention. Accordingly, the foregoing description should be considered as illustrative only and should not be interpreted to limit the scope of the present invention, which is defined by the following claims.

I claim:

1. An apparatus for removing an electrical contact mounted within an insert passage of an electrical connector, the electrical contact being of the type having a plurality of axially aligned fine wires held within and extending outwardly from a sleeve, the apparatus comprising:

a first member having a forward end for insertion into said insert passage and an internal bore within the member extending rearwardly from the forward end, said bore having a forward portion of a larger diameter, another portion of a smaller diameter located rearwardly of the forward portion and a rearwardly facing shoulder located rearwardly of said smaller diameter portion, the bore of said first member for receiving the electrical contact therein with the contact sleeve within the forward portion and the axially aligned wires extending through the other portion and beyond the rearwardly facing shoulder when the forward end of said first member is inserted into the insert passage; and a second member having a forwardly tapering end portion and mounted within said bore of the first member for reciprocal movement between a rear position and a forward position, said forward end portion extending forwardly within the smaller diameter portion of the bore of said first member when the second member is in its forward position, said tapering end portion for urging the fine wires of the electrical contact outwardly and into pressure contact with the rearwardly facing shoulder when the first member has been inserted into insert passage and an electrical contact is within the bore of said first member and said second member is moved from the rear position to the forward position, whereby when the forward end of said first member is inserted into a passage and an electrical contact is within the forward portion of the bore of said first member and said axially aligned wires extend through the smaller diameter portion of the bore and said second member is moved from its rear position to its forward position, the forwardly tapering end portion of said second member urges the fine wires into pressure contact with the rearwardly facing shoulder of the first member, the contact is firmly held between the first and second members of the apparatus so that the contact may be removed from said insert passage by the removal of the apparatus.

2. A contact removal apparatus of the type described in claim 1 including a slot extending through the first member to communicate with the bore and extending rearwardly from the forward end, with said slot aligned with a contact wire which has been bent away from axially alignment, whereby a contact having a bent contact wire may be removed from the passage by the apparatus by aligning the slot with the bent wire before inserting the first member over the contact.

3. An apparatus of the type described in claim 1 wherein a wall portion tapering rearwardly inwardly is positioned between said forward larger diameter portion and smaller diameter portions to provide means for guiding the axially aligned wires into said smaller diameter portion as the first member of said apparatus is inserted over the contact.

4. An apparatus of the type described in claim 1 wherein said electrical contact includes an enlarged portion held within the insert passage by resilient fingers which are outwardly deflectable and said apparatus includes an external surface for deflecting the fingers outwardly to release the enlarged poriton of the contact from the resilient fingers, whereby the contact is releasable from the insert passage by the apparatus.

5. An apparatus of the type described in claim 1 wherein said first and second members are secured together to limit the movement of one member with respect to the other member and to prevent separation of the two members.

6. A contact removal apparatus for removing an electrical contact mounted to an electrical connector, the electrical contact being of the type having several wires extending in one direction from a sleeve and having an electrical termination extending in another direction, said termination for receiving an electrical conductor, the apparatus comprising:

a first member having an external surface with a forward end and an internal bore extending rearwardly from the forward end, said bore for receiving at least a portion of the electrical contact therein with the wires extending within said first member when the member is inserter over the contact;

a second member mounted within said bore of the first member for reciprocal movement between a first position and a second position relative to the first member and including means for urging the fine wires of the electrical contact outwardly and into pressure contact with a portion of the bore when the first member has been inserted over an electrical contact and the wires are within the bore of said first member and said second member is moved from its first position to its second position with said urging means positioned to avoid pressing the wires into pressure contact with the bore when the second member is in its first position, whereby when the forward end of said first member is inserted over an electrical contact with the wires within the bore and said second member is moved from its first position to its second position, the second member urges the fine wires into pressure contact with the other portion of the bore, the contact is firmly held by the apparatus so that the contact may be removed from its mounting to the electrical connector by the removal of the apparatus, thereafter when the second member is moved to its first position, the contact is released from its pressure contact within the bore of the first member.

7. A contact removal apparatus for removing an electrical contact mounted to an electrical connector, the electrical contact being of the type having at least one deflectable element mounted within a sleeve toward its rear end and extending forwardly within the sleeve, the apparatus comprising:

a first member having an external surface with a forward end and an internal bore extending rearwardly from the forward end for receiving at least a portion of the deflectable contact element therein when the first member is inserted over the contact; and a second member mounted within said bore of the first member for reciprocal movement between a first position and a second position relative to the first member, said member including means for urging the deflectable element of the electrical contact outwardly and into pressure contact with a portion of the bore when the first member has been inserted over an electrical contact and the wires are within the bore of said first member and said second member is moved from its first position to its second position, whereby when the forward end of said first member is inserted over an electrical contact with the wires within the bore and said second member is moved from its first position to its second position, the urging means of said second member urges the deflectable element into pressure contact with the other portion of the bore, the contact is firmly held by the apparatus so that the contact may be removed from its mounting to the electrical connector by the removal of the apparatus, and thereafter when the second member is moved to its first position, the contact is released from its pressure contact within the bore.

* * * * *